United States Patent [19]

Little

[11] Patent Number: 4,519,020

[45] Date of Patent: May 21, 1985

[54] VARIABLE MAGNIFICATION STAGE LIGHT

[76] Inventor: William D. Little, 3548 Townsend Dr., Dallas, Tex. 75229

[21] Appl. No.: 551,031

[22] Filed: Nov. 14, 1983

[51] Int. Cl.[3] ..... F21V 7/00

[52] U.S. Cl. ..... 362/268; 362/277; 362/281; 362/296; 362/305; 362/310; 362/331; 362/433; 362/455

[58] Field of Search ..... 362/268, 277, 281, 296, 362/305, 310, 331, 433, 455

[56] References Cited

U.S. PATENT DOCUMENTS

| | | | |
|---|---|---|---|
| 2,650,292 | 9/1953 | Strong | 240/3 |
| 3,484,599 | 12/1969 | Little | 240/41.3 |
| 4,029,956 | 6/1977 | Leibundgut | 362/268 |
| 4,101,957 | 7/1978 | Chang | 362/268 |
| 4,151,584 | 4/1979 | Labrum | 362/373 |
| 4,187,534 | 2/1980 | Tichenor | 362/268 |
| 4,232,359 | 11/1980 | Leon | 362/268 |
| 4,338,654 | 7/1982 | Logothetis | 362/268 |

*Primary Examiner*—Donald P. Walsh

*Attorney, Agent, or Firm*—Glaser, Griggs & Schwartz

[57] ABSTRACT

A variable magnification "zoom" spotlight assembly is disclosed in which the diameter and focal length of the focusing lens and object lens are selected so that the angle of incidence of a light ray as it emanates from the lamp and reflector of the assembly and thereafter from the focusing and objective lenses decreases by a constant factor. This angular relationship is established by selecting the diameter and focal length of the focusing lens and objective lens and the diameter and length of the reflector according to the following angular relationship:

$$B_R/B_F \cong B_1/B_R \cong B_2/B_1 = k$$

Where:

$B_F$=angle of the filament to reflector as measured from the focal axis;

$B_R$=angle of gate to reflector as measured from the focal axis;

$B_1$=angle of focusing lens as measured from its focal length along the focal axis to its radius;

$B_2$=angle of objective lens as measured from its focal length along the focal axis to its radius; and, k=constant.

8 Claims, 3 Drawing Figures

VARIABLE MAGNIFICATION STAGE LIGHT

BACKGROUND OF THE INVENTION

1. Field of the Invention

This invention relates generally to light projection apparatus, and in particular to a spotlight or floodlight of the type suitable for stage lighting.

2. Description of the Prior Art

Conventional illumination systems, especially for soft lighting or spot flooding applications, are somewhat inefficient and complex. For stage lighting and studio lighting applications, the spot projectors must be adapted to vary the area of illumination to accomodate different stage settings. The inefficiency of conventional projectors used for this purpose usually requires the use of two or more projectors to produce the desired illumination. Additionally, projectors that have the capability of producing a variable area of illumination are generally expensive in terms of the large number of lenses which must be kept on hand so that specific combinations of lenses can be selected for producing a particular illumination effect.

Equipment for stage lighting and the like has undergone significant changes over the last 50 years. Early designs for plano-convex spotlights included a lamp, a plano-convex lens and a reflector. These conventional units have been replaced by fresnel lenses and ellipsoidal reflector spotlights. The advances in these units have been primarily in mounting construction, rather than optics and efficiency.

In the early development of elipsoidal spotlights, only two sizes were in common use: a 250-500-750 watt unit with two 6 inch diameter by 9 inch focal length lenses mounted together and movable as a single lens for focusing, and an 8 inch diameter by 12 inch focal length lens unit using 1000-1500-2000 watt lamps. The use of the 8 inch diameter units has for the most part been discontinued. The most commonly used ellipsoidal units to date include 3½ inch, 4½ inch, 6 inch, 10 inch, 12 inch and 14 inch lens diameter units with a power rating of 300–1000 watts.

The number of lens combinations for practical spotlights is around 50. The cost of these units in recent years has increased as much as five times. The use of these numerous lens variations has become so costly and complicated that an experienced designer is required to specify a lens combination for a particular stage application.

OBJECTS OF THE INVENTION

The general object of this invention is to provide an efficient, economical and versatile spotlight which is capable of zoom performance over a wide range and which uses commonly available lenses.

A related object of the invention is to provide a variable magnification stage light which can be set up quickly and manually by untrained personnel and without the need for special tools.

In stage lighting applications, there are two categories of spotlight projectors: (1) follow spots which are usually manually controlled and focused on movements of actors with changes of colors, size of beam and direction; and (2) set spots, which are usually hung on overhead supports and adjusted to one focus, one color and then remotely controlled by switches and dimmers. A further object of the present invention is to provide a variable magnification light projector which can be used to good advantage as a follow spot as well as a set spot projector.

SUMMARY OF THE INVENTION

The foregoing objects are achieved by a variable magnification spotlight assembly in which the diameter and focal length of the focusing lens and objective lens are selected so that the angle of incidence of a light ray as it emanates from the lamp and reflector of the assembly and thereafter from the focusing lens and from the objective lens decreases by a constant factor.

The principal elements of the variable magnification spotlight assembly are a lamp which is housed within a reflector, a gate having a gate aperture, a focusing lens and an objective lens. These components are enclosed within a tubular housing. The gate is a disc which has aa circular opening. The axial position of the lamp within the reflector is adjustable over a limited range. The positions of the objective lens and the focusing lens are adjustable along the axis of the assembly. The invention resides in the selection of the focusing lens diameter and its focal length, and the selection of the diameter of the objective lens and its focal length and the selection of the reflector and its spacing relative to the gate. These parameters are selected so that the following ratio is satisfied:

$$B_R/B_F \approx B_1/B_R \approx B_2/B_1 = k$$

Where:

$B_F$ = angle of the filament to reflector as measured from the focal axis;

$B_R$ = angle of gate to reflector from focal axis;

$B_1$ = angle of focusing lens as measured from its focal length along the focal axis to its radius;

$B_2$ = angle of objective lens from its focal length along the focal axis to its radius; and, k = constant.

The lens system defined above provides a progressive decrease of angular projection which is achieved at a constant rate and without loss of light. The projected image of the gate aperture is determined by the effective focal length of the lens combination, and the outside dimensions of the gate aperture. The gate aperture size is determined by the reflector design, size and finish for efficiency.

For maximum efficiency and variable magnification (zoom) ratio, the focal length ratio $f_2$:$f_1$ of the objective lens and focusing lens is preferably less than or equal to 2.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawings.

DETAILED DESCRIPTION OF THE PREFERRED EMBODIMENT

Figure 1:
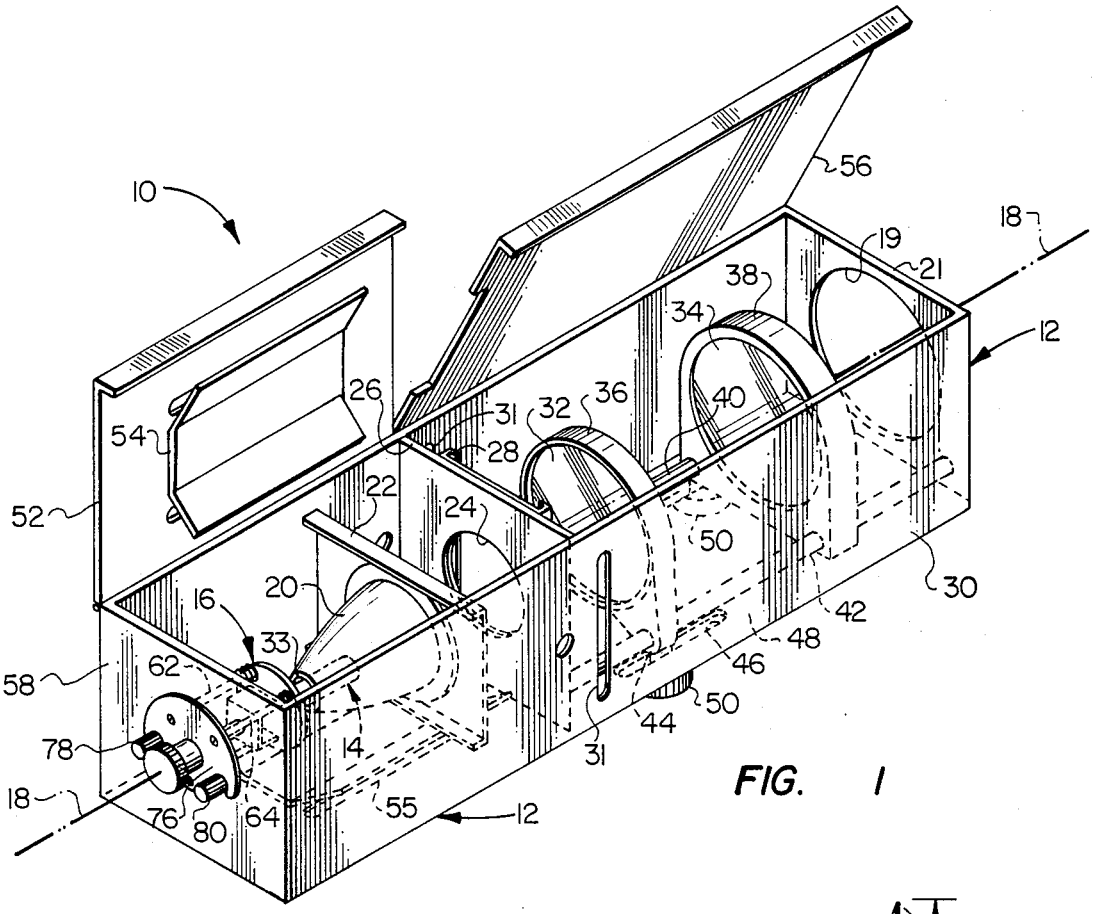
FIG. 1 is a partially open, perspective view of a spotlight made in accordance with the teachings of the present invention.

In the description which follows, like parts are marked throughout the specification and drawings with the same reference numerals, respectively. The drawings are not necessarily to scale, and in some instances, proportions have been exaggerated in order to more clearly depict certain features of the invention.

Referring now to FIG. 1, a spotlight projector 10 includes a housing 12 of rectangular cross-section. A lamp 14 mounted on an adjustable support assembly 16 produces a high intensity light beam which is projected along an optical axis 18 through a projection aperture 19 formed in front panel 21 of the housing. A color filter (not illustrated) can be mounted on the front panel 21 over the projection aperture 19, if desired.

The lamp 14 is enclosed within an ellipsoidal reflector 20 which is held in axial alignment with the optical axis 18 by a mounting bracket 22. Light emanating from the lamp 14 is projected through a circular gate aperture 24 formed in a gate plate 26. The gate aperture diameter is determined by the reflector design, size and finish. A template holder 28 is attached to the gate plate 26 forwardly of the gate aperture 24 for receiving one or more spot pattern framing shutters as desired. Side panel 30 has a slot 31 through which a framing shutter can be inserted. The other side panels of the housing 12 are also provided with slots or notches for this purpose.

The reflector 20 as illustrated is ellipsoidal, but may be any other convex surface of revolution such aas paraboloidal or spherical. The reflector 20 has a rear access opening 31 for insertion of the lamp 14.

The light beam passed by the gate aperture 24 is focused along the optical axis 18 by a focusing lens 32 having a diameter and focal length which bears a particular relationship to the diameter and focal length of the objective lens 34 as will be discussed in detail hereinafter. The focusing lens 32 and objective lens 34 are each concentrically aligned with the optical axis 18 by annular lens carrier frames 36, 38, respectively. The lens carriers 36, 38 are slidably mounted on parallel slider bars 40, 42.

The axial position of each lens relative to the gate aperture 24 is manually adjustable by axial movement of each lens along the slider bars 40, 42. Each lens carrier includes a threaded fitting 44 which projects through an elongated slot 46 which is formed in the base panel 48 of the housing 12. The lens carrier is secured in place by a threaded knob 50 which is torqued against the base panel 48 and onto the threaded fitting 44. Each lens carrier can be moved axially along the slider bars 42 by loosening the knob 50 and pushing or pulling against the knob 50 while observing the projected spot until the desired effect is produced.

Access to the lamp and reflector is provided by a hinged panel 52 which is pivotally mounted onto the housing 12 and is located directly above the lamp and reflector assembly. An upper radiation shield 54 is mounted onto the underside of the panel 52, and a lower radiation shield 55 is mounted onto the inside surface of the base panel 48. Ventilation openings (not illustrated) are provided in the housing 12 in the usual manner. Likewise, access to the lens compartment is provided by a hinge panel 56.

It should be understood that the hinged panels 52, 56 are provided for maintenance and repair purposes only, and for insertion of framing shutters, pattern grids and color filters during initial set-up. Access to the lamp compartment or the lens compartment is not required after initial set-up because of the unique lens arrangement of the invention as set out below.

The distribution of the light flux energy is important in the operation of the spotlight projector 10. Adjustment of the lamp position within the reflector 20 varies the projected beam distribution from a central peak pattern to a flat field pattern. Axial positioning of the lamp 14 along the focal axis 18 is provided by the lamp support assembly 16 which is mounted onto the back panel 58 of the housing 12.

Figure 3:
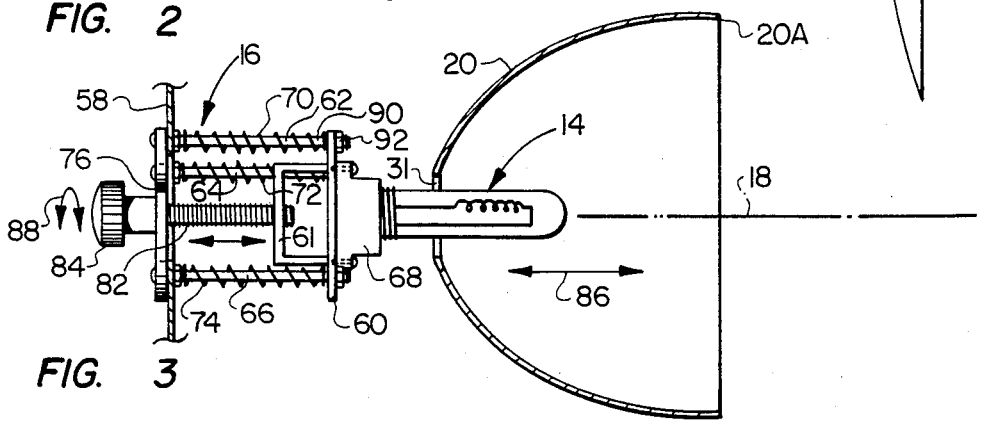
FIG. 3 is an elevation view, partly in section, of the lamp and reflector combination shown in FIG. 1.

Referring now to FIG. 3, the lamp support assembly 16 includes a carriage plate 60 which is mounted for sliding movement along three support posts 62, 64 and 66. A lamp socket 68 is mounted onto the carriage plate 60. The carriage plate 60 is biased for movement away from the back panel 58 by compression springs 70, 72 and 74 which are coiled around the support posts 62, 64 and 66, respectively. The support posts 62 are stabilized by a mounting plate 76 which is secured onto the back plate 58 by mounting fasteners 78, 80. Power conductors (not illustrated) are connected to the lamp sockets 68 and are routed through the mounting panel 76. According to this arrangement, the entire lamp support assembly 16 can be removed for inspection, repair or replacement by releasing the fasteners 78, 80 and withdrawing the entire lamp support assembly.

The axial position of the lamp 14 is adjustable by a threaded adjustment shaft 82 which projects through the mounting plate 76 and is received in threaded engagement with the lamp socket carriage bracket 60. A knob 84 attached to the threaded shaft 82 permits easy adjustment of the lamp position as indicated by the arrow 86 in response to rotation of the knob 84 as indicated by the arrow 88. This permits the rapid alteration of light output characteristics. By adjusting the axial position of the lamp 14, flat and peak fields can be created, and the beam angle can be varied. This adjustment feature also permits the operator to compensate for lamp filament variations in lamps of different brands and types.

Further adjustment of the position of the lamp 14 relative to the optical axis 18 is provided by altering the effective length of the support posts 62, 64, 66. Each support post has a threaded end portion 90 which is received within a threaded fastener 92 attached to the carriage bracket 60. There is sufficient clearance between the support post 62 and the carriage plate 61 to permit the carriage plate and mounting bracket to tilt slightly as the support post is turned through the threaded fastener 92. This in turn causes the lamp 14 to pitch slightly with respect to the optical axis 18, thereby altering the position of the lamp and filament within the reflector 20.

I have discovered by extensive testing that maximum efficiency and zoom range are obtained when the reflector, gate, focusing lens and objective lens are selected so that the angle of incidence of a light ray as it emanates from the lamp and reflector of the assembly and thereafter from the focusing lens and from the objective lens decreases by a constant factor. In particular, I have found that for maximum efficiency, the focal length ratio is:

$$f_2/f_1 \leqq 2$$

According to this arrangement, the objective lens will receive substantially all of the light passed by the focusing lens. This ratio can be approximated by commonly available lenses.

Figure 2:
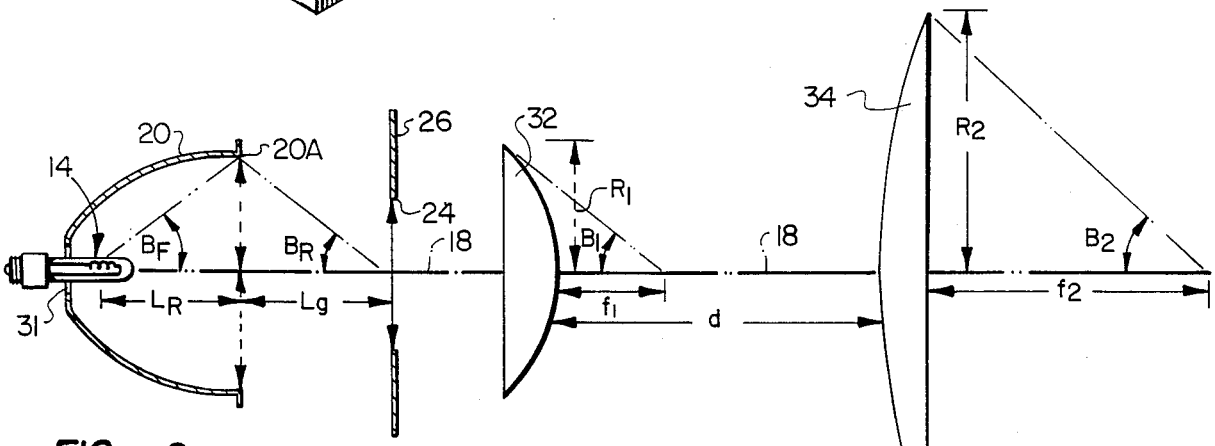
FIG. 2 is a diagram of the lamp and lens system shown in FIG. 1.

The essential angular relationship of the invention can be understood by referring to FIG. 2 of the drawings. $B_F$ is the angle of the filament to the lip 20A of the reflector as measured from the focal axis 18. $B_R$ is the angle of gate to reflector as measured from the point where the optical axis 18 intersects the gate plane to the reflector lip 20A. $B_1$ is the angle of the focusing lens as measured from its focal length $f_1$ along the focal axis to its radius $R_1$. $B_2$ is the angle of the objective lens 34 as measured from its focal length $f_2$ along the focal axis to its radius $R_2$. The angular relationship is expressed as follows:

$$B_R/B_F \cong B_1/B_R \cong B_2/B_1 = k$$

Where:

$B_F$=angle of the filament to reflector as measured from the focal axis;

$B_R$=angle of gate to reflector from focal axis;

$B_1$=angle of focusing lens as measured from its focal length along the focal axis to its radius;

$B_2$=angle of objective lens from its focal length along the focal axis to its radius; and, k=constant.

I will now provide an example of an optical system which utilizes commonly available lenses and reflectors which can be arranged to satisfy the angular relationship identified above. This particular example uses a coiled filament tungsten lamp, an ellipsoidal reflector having a 4 inch diameter and depth of $3\frac{1}{4}$ inches, a planoconvex focusing lens 32 having a diameter of $4\frac{1}{2}$ inches and a focal length $f_1$ of $6\frac{1}{2}$ inches, and a planoconvex objective lens having a 6 inch diameter and a 12 inch focal length $f_2$. It will be noted that $$f_2/f_1 = 12/6.5 = 1.846 \leqq 2$$

thereby satisfying the focal length constraint for maximum efficiency as previously discussed.

The zoom ratio is defined as the ratio of the effective focal length $f_e$ at maximum separation divided by effective focal length at minimum separation. In this instance, when d(distance between lenses)=0:

$$f_e\,(\text{min}) = \frac{f_1 \times f_2}{f_1 + f_2 - d} = \frac{6.5 \times 12}{6.5 + 12} = \frac{78}{18.5} = 4.216 \text{ inches}$$

For maximum separation, that is when d=12:

$$f_e\,(\text{max}) = \frac{f_1 \times f_2}{f_1 + f_2 - d} = \frac{6.5 \times 12}{6.5 + 12 - 12} = \frac{78}{6.5} = 12 \text{ inches}$$

Therefore, the zoom ratio for this particular example is:

$$\text{zoom ratio} = \frac{f_e\,(\text{maximum separation})}{f_e\,(\text{minimum separation})} = \frac{12}{4.216} = 2.846$$

Referring again to FIG. 2, the various angles are computed aas follows:

$$B_F \text{arc tan } (R_R/L_R) = \text{arc tan } (2/2.75) = 36°$$

$$B_R = \text{arc tan } (R_R/L_g) = \text{arc tan } (2/4) = 26.5°$$

$$B_1 = \text{arc tan } (R_1/f_1) = \text{arc tan } (2.25/6.5) = 19°$$

$$B_2 = \text{arc tan } (R_2/f_2) = \text{arc tan } (3/12) = 14°$$

The actual value of these approximate angular relationships are shown as follows:

$$B_R/B_F \cong B_1/B_R \cong B_2/B_1$$

$$26.5°/36° \cong 19°/26.5° \cong 14°/19°$$

$$0.7361 \cong 0.7169 \cong 0.7368$$

From the foregoing example, it is evident that a progressive decrease of angular projection is achieved at a constant rate, and substantially without loss of light.

The foregoing angular relationship is approximate because commonly available standard size lenses were utilized. It should be understood that the angular relationship theoretically can be stated as an equality relationship if ideal lenses of specific dimensions are provided.

Although a preferred embodiment of the invention has been described in detail, it should be understood that various changes, alterations and substitutions can be made therein without departing from the spirit and scope of the invention as defined by the appended claims.

I claim:

1. An optical projection system for projecting light onto an object in which the area of projected illumination is selectively variable comprising, in combination:

a projector housing having an open end through which light may be projected along an optical axis;

an open ended reflector received within said housing and aligned generally with said optical axis, said reflector having a lip radius $R_R$;

a lamp disposed within said reflector;

first and second lenses spaced apart on said optical axis through which light from said light source successively passes and is projected out said open end, said first lens having a radius $R_1$ and a focal length $f_1$, and said second lens having a radius $R_2$ and a focal length $f_2$;

a gate having a gate aperture interposed between said reflector and said first lens at an axial distance $L_g$ from said reflector; and, the diameter of said reflector and its axial spacing with respect to the gate aperture, together with the diameter and focal length of said lenses being selected whereby the following ratio is established:

$$B_1/B_R \cong B_2/B_1 = k$$

where:

$B_R$=arc tan $(R_R/L_g)$;

$B_1$=arc tan $(R_1/f_1)$;

$B_2$=arc tan $(R_2/f_2)$; and, $k$=constant.

2. An optical projection system as defined in claim 1, wherein:

$$f_2/f_1 \leqq 2$$

3. An optical projection system for projecting light onto an object in which the area of projection illumination is selectively variable comprising, in combination:

a projector housing have an open end through which light may be projected along an optical axis;

an open ended reflector received within said housing and aligned generally with said optical axis, said reflector having a lip radius $R_R$ and an axial length $L_R$;

a lamp disposed within said reflector;

a lens spaced apart from said reflector on said optical axis through which light is projected out said open end, said lens having a radius $R_1$ and a focal length $f_1$;

a gate having a gate aperture interposed between said reflector and said lens at an axial distance $L_g$ from said reflector; and, the diameter of said reflector aand its axial spacing $L_g$ with respect to the gate aperture, and the length $L_R$ of said reflector together with the diameter and focal length of said lens being selected whereby the following ratio is established:

$$B_R/B_F \cong B_1/B_R = k$$

where:

$B_F$=arc tan $(R_R/L_R)$;

$B_R$=arc tan $(R_R/L_g)$;

$B_1$=arc tan $(R_1/f_1)$; and, $k$=constant.

4. An optical projection system for projecting light onto an object in which the area of projected illumination is selectively variable comprising, in combination:

a projector housing having an open end through which light may be projected along an optical axis;

an open ended reflector received within said housing and aligned generally with said optical axis, said reflector having a lip radius $R_R$ and an axial length $L_R$;

a lamp disposed within said reflector;

first and second lenses spaced apart on said optical axis through which light from said light source successively passes and is projected out said open end, said first lens having a radius $R_1$ and a focal length $f_1$, and said second lens having a radius $R_2$ and a focal length $f_2$;

a gate having a gate aperture interposed between said reflector and said first lens at an axial distance $L_g$ from said reflector; and, the diameter of said reflector and its axial spacing with respect to the gate aperture, together with the diameter and focal length of said lenses being selected whereby the following ratio is established:

$$B_R/B_F \cong B_1/B_R \cong B_2/B_1 = k$$

where:

$B_F$=arc tan $(R_R/L_R)$;

$B_R$=arc tan $(R_R/L_g)$;

$B_1$=arc tan $(R_1/f_1)$;

$B_2$=arc tan $(R_2/f_2)$; and, $k$=constant.

5. An optical projection system as defined in claim 4, wherein:

$$f_2/f_1 \leqq 2$$

6. In a light projecting assembly, a support, means for establishing a beam of light including a reflector and a light source disposed within said reflector; a pair of relatively movable lens disposed in the path of the beam of light; a carrier for each of said lenses movable upon the support axially of the light beam; the diameter of the reflector and the diameter and focal length of the lenses and their relative spacing being selected whereby the angle of incidence of a light ray as it emerges from the reflector and thereafter from the focusing lens and from the objective lens, decreases by a constant factor.

7. In a light projector assembly of the type including a housing having an optical axis, an open end reflector aligned with said optical axis and a lamp disposed within said reflector, the improvement comprising lamp support means removably mounted to said housing for selective movement and retention of said lamp generally along said optical axis, said lamp support means including a carriage bracket, a lamp socket mounted on said carriage bracket, a plurality of support posts mounted onto said housing and projecting into said housing, said carriage bracket being coupled for sliding movement along said support posts, a compression spring interposed between said housing and said carriage bracket, thereby biasing said carriage bracket for sliding movemnent along said posts away from said housing, and a threaded adjustment shaft coupled to said carriage bracket and said housing for extending and retracting said carriage bracket along said optical axis in response to rotation of said threaded shaft.

8. A method for operating a light projector assembly of the type including a gate means for projecting a beam of light through said gate including a reflector and a light source disposed within the reflector, and a pair of relatively movable lens disposed in the path of the beam of light, comprising the steps of selecting the diameter of the reflector and the diameter and focal length of the lenses and adjusting the spacing of the reflector and gate whereby the angle of incidence of a light ray as it emerges from the reflector, through the gate, and thereafter through the focusing lens and the objective lens decreases by a constant factor.

* * * * *